United States Patent [19]

Smith et al.

[11] Patent Number: 4,530,496

[45] Date of Patent: Jul. 23, 1985

[54] DEVICE FOR EXERCISE AND/OR THERAPY

[75] Inventors: Leonard E. Smith, West Carrollton; James Johnson, Kettering, both of Ohio

[73] Assignee: IMNETEC Inc., Dayton, Ohio

[21] Appl. No.: 461,535

[22] Filed: Jan. 27, 1983

[51] Int. Cl.[3] ..... A63B 21/30

[52] U.S. Cl. ..... 272/68; 73/379; 73/729; 272/130

[58] Field of Search ..... 73/379, 729, 715; 272/67, 68, 130

[56] References Cited

U.S. PATENT DOCUMENTS

| | | | |
|---|---|---|---|
| 2,577,100 | 12/1951 | Alvarez | 73/715 |
| 2,708,367 | 5/1955 | Lusk | 73/379 |
| 4,114,449 | 9/1978 | Dikeman | 73/379 |
| 4,222,560 | 9/1980 | Hallerman | 272/130 |
| 4,248,421 | 2/1981 | Salazar | 272/130 |

*Primary Examiner*—Richard J. Johnson

*Attorney, Agent, or Firm*—Becker & Becker, Inc.

[57] ABSTRACT

A device and system for the purpose of exercise and/or physical therapy through use of a primary vessel of pliable plastic material that forms a hollow main body portion at least partially filled with liquid and a second portion in an integral unit with the main body portion and filled with gas or air reservoir of an entrapped volume compressible under pressure of compressive force applied to the main body portion for exercise and therapy involving a finger, fingers, hands, arms, shoulder, chest muscles, jaw, knee, elbow and the like.

6 Claims, 9 Drawing Figures

DEVICE FOR EXERCISE AND/OR THERAPY

The present invention relates to a device and system for the purpose of exercise and/or physical therapy through use of a combination of liquid/air or fluid/gas pressures to vary the amount of physical effort needed to accomplish a desired objective.

An object of the present invention is to provide a pliable vessel in a unitary body of transparent or semi-transparent material, at least partially filled with a liquid and having an air reservoir tightly enclosed therein as a sealed system, such that as the pliable vessel is deformed by application of forces at various locations, the liquid transmits force and consequently compresses the air also trapped within, thereby causing an ever increasing resistance to further physical deformation of the pliable vessel.

A further object of the present invention is to provide a device for exercise and/or therapeutic purposes including a pliable vessel in a unitary plastic body having a fluid and a gas entrapped therein subject to external compression force applicable, for example, to a bulbous portion of the plastic body engaged manually by at least one finger in a finger-contoured recess or depression at one bottom end of the body or laterally thereof to permit finger and hand muscle exercises, or engageable in or under a knee or elbow joint, or engageable between two hands like an accordian, or engageable in a jaw bite by an individual for therapeutic treatment and exercise.

This object, and other objects and advantages of the present invention, will appear more clearly from the following specification in connection with the accompanying drawings, in which.

Figure 1:
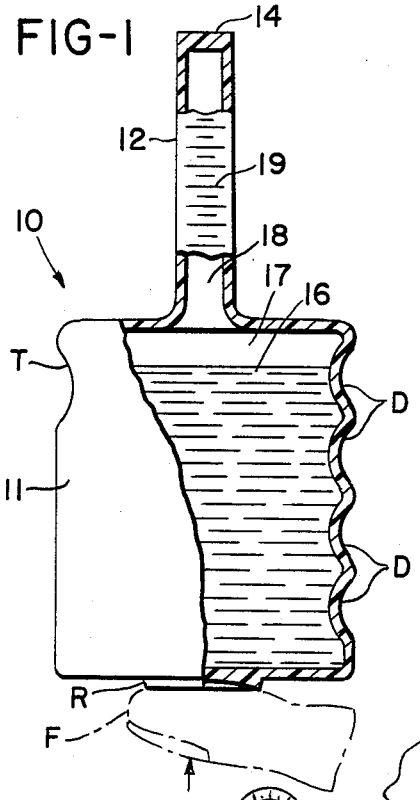
FIG. 1 is a partially sectioned elevational view of a device for exercise and/or therapy having features in accordance with the present invention.
Figure 2:
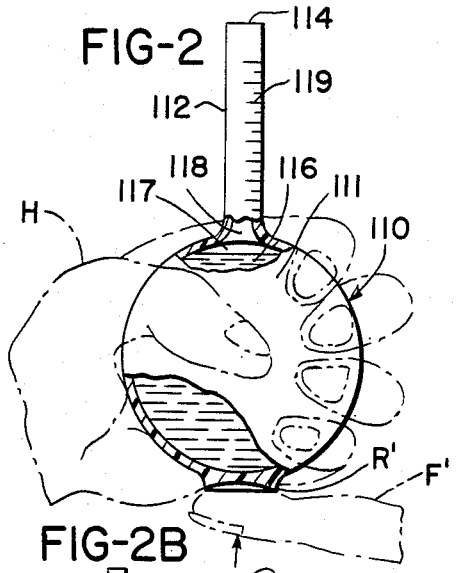
FIG. 2 is a partially sectioned elevational view of a device similar to that of FIG. 1 and including a ball-type squeegee grasped manually for therapeutic and/or exercise purposes.

Referring now to the drawings in detail, FIG. 1 generally shows a device 10 having a unitary body 11 of pliable, transparent or semi-transparent plastic material including an integral stem portion 12 sealed tightly at an upper end 14 thereof. A fluid or liquid 15 substantially fills the interior space of chamber 17 of the body 11 which communicates with a hollow interior 18 of the stem portion 12 filled with a gas such as an air column or air reservoir compressible by force applied manually to the body portion via a finger F against a bottom depression or recess R of FIG. 1 or finger F′ against the bottom depression or recess R′ of FIG. 2. Pressure indicator markings or gradations 19 are formed integrally with the stem portion 12. Reference numerals increased by 100 refer to structural features of FIG. 2 corresponding to those of FIG. 1.

Figure 5:
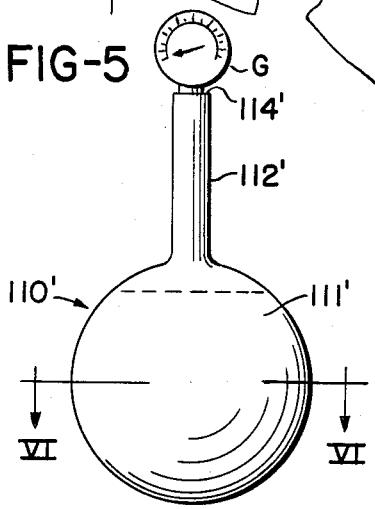
FIG. 5 is a side view of a device having a sealed stem and pressure gauge in accordance with the present invention.
Figure 6:
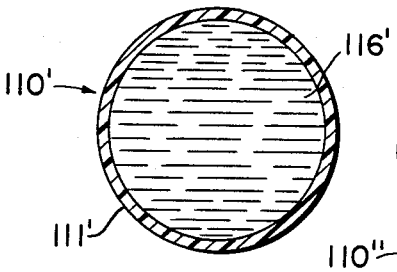
FIG. 6 is a cross-section view taken along line VI—VI in FIG. 5.

A band can manually grasp finger grooves, semi-circular shaped indentation of depressions D and thumb groove T located laterally and extending radially of the body 11 as shown in FIG. 1. A hand can grasp the body 111 of the ball-type squeegee unit of FIG. 2 as illustrated. Compressive force or pressure transmitted by a finger, fingers and/or the hand to the body of pliable material, such as polypropylene, polyamide, neoprene, butadiene, vinyl and the like. The fluid or liquid, for example, is water or ethylene glycol, if an anti-freeze solution is advisable for cool-weather outdoor use. A clear or color-tinted liquid is used if necessary as an aid to monitoring height or level of liquid forced along the gradations commensurate with the strength and exercise force being applied to the bulbous body of pliable material. The stem portion is also bendable, flexural or pliable over a wide range of temperatures from summer heat to sub-freezing values. Liquid level in the stem portion indicates pressure applied. As the device is compressed, liquid rises in a column; a pressure gauge G or optional pressure sensor is hermetically pressure and/or heat sealed to an end 114′ of stem portion 112′ of the body 111′ of the device 110′ of FIGS. 5 and 6.

Figure 2A:
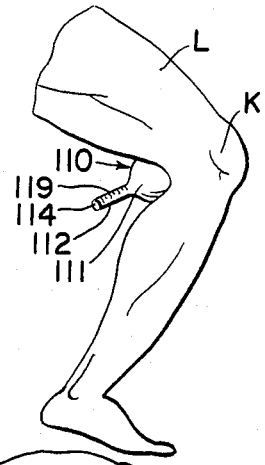
FIG. 2A shows the device of FIG. 2 being used under a knee joint of an individual leg.

FIG. 2A shows another application or employment of the device 110 underneath a knee joint K of an individual leg L and arrows represent movement for compressive force or pressure being applied to the device 110.

Figure 2B:
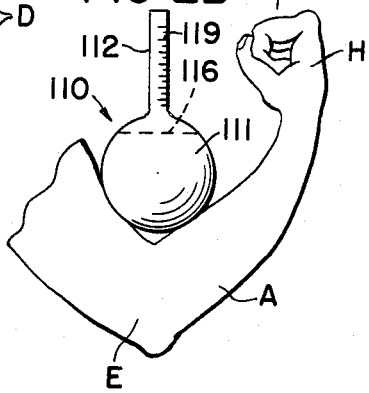
FIG. 2B shows the device of FIG. 2 being used in an elbow location of an individual arm.

FIG. 2B shows another application or employment of the device 110 in an elbow joint E of an arm A of an individual whose hand H or elbow E optionally and selectively can be exercised for limbering up or for therapeutic treatment purposes.

Figure 3:
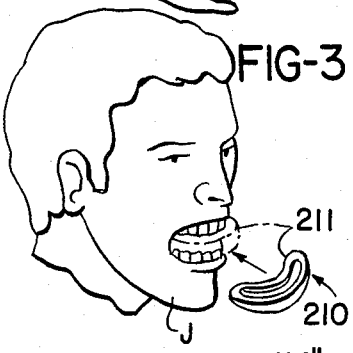
FIG. 3 shows a device having features of the present invention and engageable in a jaw bite by an individual for therapeutic treatment and exercise.

FIG. 3 shows a further modification of a jaw device 210 having a wedge-like or mouth-fitting-contour body 211 so that an individual jaw J can be exercised or given therapeutic treatment after jaw surgery or the like.

Figure 4:
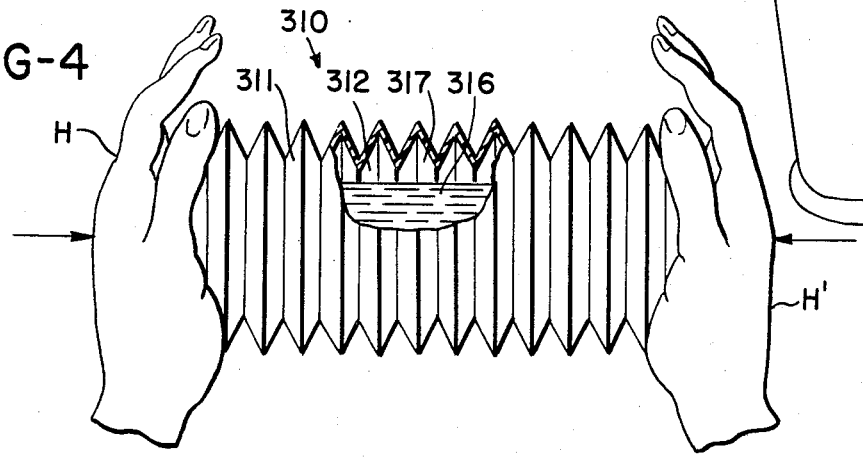
FIG. 4 is a partially sectioned side view of an accordian-type device having features in accordance with the present invention.

FIG. 4 shows still another modification of accordian-type device 310 having a pliable body 311 at least partially filled with liquid 316 in a chamber 317 in communication with multiple triangular-shaped sawtooth serrations defining multiple stem-like portions 312 therein filled with a compressible gas such as air. Also inert-gas filling can be used such a helium or the like. The accordian-type device 310 is compressible between left and right hands H, H′.

In principle, with all of the foregoing exercise/-therapeutic devices, the entrapped air or gas provides increasing resistance as each device is compressed and the amount of liquid and composition of the device is dependent on desired properties. The amount of pressure exerted may be determined by the level or height of liquid in the closed column of the stem portion. The size and shape of the device is determined by requirements of various applications.

The body of the entire device is a single, pliable unit made impervious to air by a rotocasting method. The scope and field of use of the present inventive device extends from professional sports such as football players including quarterbacks to exercise fingers, hands, arms and shoulders for a game and therapeutic applications including arthritics or post-operative exercising and therapy. A triangular prism-like body can be used for knee, elbow and jaw exercising purposes. The accordian-type body is useful for exercising and therapy of chest muscle, arm and shoulder locations. The jaw-bite exerciser is for individuals to use after a jaw operation. Golfers, baseball players, hockey players, and football players can exercise thumbs, fingers, arms, legs, jaw and chest muscle without extending or stressing any joint excessively.

Physical therapists working with recouperating stroke patients, chiropractors, osteopaths, medical practitioners and orthopedic surgeons can use the present inventive devices for their patients. Also, health spas and weight-lifting organizations can use the present inventive devices rather than spring-loaded handle devices or solid chunks of rubber. The present invention is a unique use or application of principles involved with Boyle's law and a series of exercise and therapeutic devices having features according to the present invention will permit arthritis sufferers to exercise for therapy purposes. Heart or chest muscles can be exercised by employing the accordian-type structure.

In summary, the structural arrangement and function of the device according to the present invention serves the purpose of providing exercise and/or physical therapy through application of a combination of liquid/air pressures to vary the amount of physical effort needed to accomplish a desired health, exercise or therapy objective. The sealed system works on a basis that liquid and air are sealed within a pliable vessel of a shape and size to fulfill the intended or desired objective of exercise and/or therapeutic regimen. The main body portion as a primary vessel is deformed by the application of forces at various locations so that, as the liquid is displaced or compressed, then simultaneously air that is also trapped within the body portion as the primary vessel and as the secondary portion within the stem portion or serrations or bellows-like structure causing an ever increasing resistance to further physical deformation. The amount of pressure applied can then be measured by liquid displacement pressure gauge or variable specific gravity methods.

These devices may be used singly or in combination depending on need to be fulfilled. Pressure applied on the liquid-containing vessel or body portion causes liquid to be displaced into the air reservoir portion of the stem or bellows structure. As the air is compressed (because the system is sealed), more and more pressure must be applied to cause incremental changes in the liquid level of the connected tube or stem portion extending laterally or radially outwardly from the main body portion.

Figure 5A:
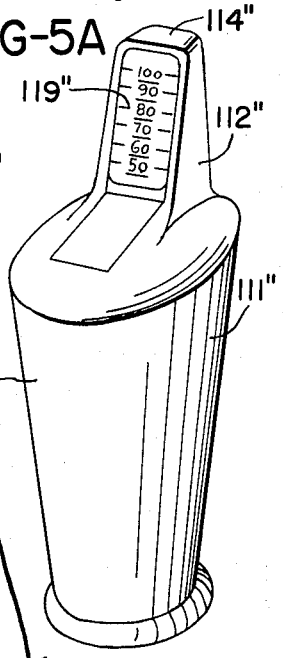
FIG. 5A is a perspective view of a streamlined exercise/therapy device.

FIG. 5A in a perspective view shows a streamlined version of a device 110" for exercise and/or therapy having a unitary body 111" with an upper L-shaped integral stem portion 112" sealed tightly at an upper end 114" thereof. A substantially U-shaped or horseshoe-like outwardly projecting bead or thickened portion is located around the periphery of the bottom or base of the body 111". The L-shaped stem portion is located integrally on a dome-shaped configuration and has a flattened angular surface in a console-like arrangement of pressure indicator markings or gradations 119" for liquid-level-displacement reading of values along the transparent or translucent plastic of the body 111".

The present invention is, of course, in no way restricted to the specific disclosure of the specification and drawings, but also encompasses any modifications within the scope of the appended claims.

What is claimed is:

1. A device for exercise and/or therapy of individuals, comprising in combination: a unitary hollow primary body of pliable material having a shape made impervious to air by a rotocasting method and including a gas reservoir portion integral therewith and enclosed therein as a sealed system, a liquid at least partially filling said primary body itself so that pressure and compressive force applied directly to said primary body with equalized pressure of shape thereof is transmitted to said liquid to displace and compress the liquid against said gas reservoir portion that is entrapped therein to provide increasing resistance as the device is compressed in the sealed system as more and more pressure must be applied to cause incremental changes in liquid displacement; said primary body including an upper L-shaped integral stem portion that is heat sealed tightly at an upper end thereof; said primary body including an outwardly projecting thickened portion located peripherally along a base thereof; said L-shaped integral stem portion being located on a dome-shaped configuration of said primary body; said L-shaped integral stem portion having a flattened angular surface in a console-like arrangement along an index-finger-like configuration protruding upwardly from said primary body; and pressure indicator markings as gradations for liquid-level-displacement in an actual reading of values that appear directly on a vertical portion of the angular flattened surface of upwardly protruding console-like arrangement unitary therewith to set forth the incremental changes in liquid displacement relative thereto from said unitary hollow primary body of pliable material anatomically more correct so as to equalize pressure over the shape of the hand.

2. A device in combination according to claim 1 in which said outwardly projecting thickened portion is in a U-shaped base to one said of the primary body that is graspable for exercise and/or therapy.

3. A device in combination according to claim 1 in which said outwardly projecting thickened portion is a horseshoe-like outwardly extending bead to one side of a tapered constriction of said primary body.

4. A device combination according to claim 1 wherein a base of said primary body is enlarged laterally of elongated configuration of said primary body.

5. A device in combination according to claim 4 wherein said base is remote from said upper L-shaped integral stem portion extending away therefrom.

6. A device in combination according to claim 5 wherein said stem portion extends flush beyond a side of the primary body.

* * * * *